US006408150B1

(12) United States Patent
Nishiyama

(10) Patent No.: US 6,408,150 B1
(45) Date of Patent: Jun. 18, 2002

(54) DEVELOPING APPARATUS FEATURING FIRST AND SECOND DEVELOPER BEARING MEMBERS AND FIRST AND SECOND MAGNETIC SEAL PORTIONS

(75) Inventor: Kazushige Nishiyama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/503,197

(22) Filed: Feb. 14, 2000

(30) Foreign Application Priority Data

Feb. 18, 1999 (JP) ..... 11-039339

(51) Int. Cl.[7] ..... G03G 15/08
(52) U.S. Cl. ..... 399/104
(58) Field of Search ..... 399/103–105, 399/269

(56) References Cited

U.S. PATENT DOCUMENTS 5,177,536 A 1/1993 Watanabe et al.
5,978,623 A * 11/1999 Itoh ..... 399/104

FOREIGN PATENT DOCUMENTS

| | | |
|---|---|---|
| JP | 2-188778 | 7/1990 |
| JP | 2-262171 | 10/1990 |
| JP | 3-204084 | 9/1991 |
| JP | 8-137259 | 5/1996 |

* cited by examiner

*Primary Examiner*—William J. Royer
(74) *Attorney, Agent, or Firm*—Fitzpatrick, Cella, Harper & Scinto

(57) ABSTRACT

A developing apparatus include a first developer bearing member and a second developer bearing member wherein, in a longitudinal direction of a first developer bearing member, a width of a second magnetic seal portion opposed to a second developer bearing member is greater than a width of each of a first magnetic seal portion opposed to the first developer bearing member.

28 Claims, 9 Drawing Sheets

DEVELOPING APPARATUS FEATURING FIRST AND SECOND DEVELOPER BEARING MEMBERS AND FIRST AND SECOND MAGNETIC SEAL PORTIONS

BACKGROUND OF THE INVENTION

1. Field of the Invention

The present invention relates to a developing apparatus for developing an electrostatic latent image formed on an image bearing member with developer.

2. Related Background Art

In the past, it is already known to provide image forming apparatuses in which, after a latent image bearing member is uniformly charged, image exposure is effected by analogue exposure or a semiconductor laser or an LED, and, after an electrostatic latent image formed on the latent image bearing member, the electrostatic latent image is visualized by a developing apparatus as a toner image. After the developer image is transferred to a transfer material as a recording material, the transfer material is separated from the latent image bearing member and is subjected to fixing treatment in a fixing device to obtain a fixed image.

Now, an operation of such a conventional image forming apparatus will be described with reference to FIG. 10.

Such an image forming apparatus includes a photosensitive drum 101 having a photoconductive layer such as OPC or, as a latent image bearing member, a-Si and is rotated in a direction shown by the arrow B.

In such an image forming apparatus, first of all, a surface of the photosensitive drum 101 is uniformly charged by a primary charger 103 to −700 Volts, for example.

Then, the surface potential of the exposed portion on the photosensitive drum 101 is reduced, by image exposure 112 corresponding to image signal information, to −200 Volts, for example, thereby forming a latent image corresponding to the image signal on the photosensitive drum 101. For example, a semiconductor laser or an LED array is used for the image exposure 112.

Then, the latent image is developed by a developing device 102 as a developing apparatus using dry one-component developer to visualize the latent image as a toner image. The developing apparatus using the dry one-component developer has a long endurance life because it is simple and exchange of carrier is not required, and, for example, jumping developing using magnetic one-component toner can be effected. Incidentally, the developing device 102 utilizes negatively charged black toner. Further, upon development, a DC bias of about −500 Volts is applied to a developing sleeve (developer bearing member) of the developing device 102 as a developing bias, thereby reversal-developing the latent image.

Thereafter, if desired, pre-transfer treatment is effected by using a charger 110 (normally, application of corona by DC or AC or photoelectricity removal or combination thereof), and then, the toner image is transferred, by a transfer charger 104, onto a transfer material supplied to the photosensitive drum 101.

Thereafter, the transfer material to which the toner image was transferred is sent to a fixing device (fixing apparatus) 107, where the toner image is fixed to the transfer material as an image. On the other hand, transfer residual toner which was not used in the development and remains on the photosensitive drum 101 is removed by a cleaning device 106, thereby preparing for next image formation.

On the other hand, in order to obtain a high speed image forming apparatus, in the conventional developing apparatus, as disclosed in Japanese Patent Application Laid-Open No. 3-204084 (1991), a plurality of developing sleeves are provided in a developing apparatus using a two-component magnet brush, or, as disclosed in Japanese Patent Laid-Open No. 2-188778 (1990), a replenishing amount of toner from developing sleeves (developer bearing members) to a photosensitive member (latent image bearing member) is made uniform by arranging the developing sleeves and the photosensitive member so the that distance between the developing sleeves and the photosensitive member is gradually decreased toward a downstream side in a rotational direction of the photosensitive member.

Next, a method for sealing developer at an axial end of the rotatable developer bearing member of the conventional developing apparatus will be described with reference to FIGS. 11 to 13.

As shown in FIG. 11, such a developing apparatus has a developer container 102*a* containing the developer, and agitating means 102B are provided in the developer container 102*a* so that the developer in the developer container 102*a* is agitated and conveyed in a predetermined direction by the agitating means 102B.

Further, the developing apparatus has a developing sleeve (developer (magnetic powder) bearing member) 120 for developing the electrostatic latent image formed on the photosensitive drum 101 and for carrying the developer in the developer container 102*a* toward the photosensitive drum 101.

Normally, the developing sleeve 120 includes non-magnetic metal at its outer periphery and also has a magnet roller (magnetic field generating means) 120*a* fixed therewithin and having a plurality of circumferential magnetic poles N1, N2, N3, S1, S2, as shown in FIG. 11.

Further, as shown in FIG. 13, a shaft 120*c* of the developing sleeve 120 is supported by side walls 102*e* of the developer container 102*a* via bearings 120*b*. Incidentally, FIG. 13 shows only one side wall 120*e*.

With the above-mentioned arrangement, by the rotation of the developing sleeve 120, the developer is carried from the magnetic pole S3 to the magnetic pole N1 while being borne by the developing sleeve 120, and an amount of developer on the developing sleeve 120 is regulated by a developing blade 102*g* supported by a support plate 102*f* to form a thin developer layer on the developing sleeve 120. Incidentally, the magnetic pole N2 is a main developing pole where the electrostatic latent image on the photosensitive drum 101 is developed by the developer. Thereafter, the developer is returned into the developer container 102*a* by the rotation of the developing sleeve 120.

In the past, in a method for mechanically scraping the developer on the developing sleeve by felt in order to seal the developer at the ends of the developing sleeve, torque for driving the developing sleeve might become great and a great load may act on a motor to shorten endurance life of the motor and the toner may be firmly fixed to the end of the sleeve due to an increase in temperature at the sleeve ends.

Further, the developer circulated within the developer container 102*a* in the above-mentioned manner is shifted toward the bearings 120*b* along the surface of the developing sleeve 120 and leaks through the axial ends of the developing sleeve 120 to be scattered in a main body of the image forming apparatus, thereby causing various inconveniences.

In order to prevent the developer from leaking through the sleeve ends, as disclosed in Japanese Patent Application Laid-Open No. 2-262171 (1990), magnet brushes of developer are formed at both axial ends of the developing sleeve 120 along at least a part of the peripheral surface of the developing sleeve 120 with predetermined gaps with respect to the surface of the developing sleeve 120, so that the developer is sealed by the magnet brushes not to leak through the axial ends of the developing sleeve 120 (FIG. 12).

Further, as an improvement, as disclosed in Japanese Patent Laid-Open No. 8-137259 (1996), there has been proposed a method in which sawteeth are provided radially of the developing sleeve to concentrate the magnetic force, thereby sealing the developer not to leak through the axial ends of the developing sleeve.

However, as is in the above-mentioned conventional developing apparatus, in a developing apparatus having a plurality of developer bearing members for high speed operation, although there is an advantage that the developing ability is enhanced, the developer may leak through the axial ends of the developing sleeves (developer bearing members) due to high speed rotations of the developer bearing members.

Further, in the developing apparatus having the plural developing sleeves, the toner scattered in a developing portion at an upstream side in the rotational direction of the photosensitive drum will be dropped onto the developing sleeve disposed at a downstream side in the rotational direction. Particularly, the toner, which is scattered outside of the seal portions provided at the axial ends of the developing sleeve disposed at a downstream side in the rotational direction of the photosensitive drum, may be scattered within the image forming apparatus as the developing sleeve disposed at a downstream side in the rotational direction of the photosensitive drum is rotated. Since such a phenomenon occurs noticeably when alternating electric field is used in the developing portion at the upstream side in the rotational direction of the photosensitive drum or when one-component magnetic developer having no carrier is used, for example, such a phenomenon leads to a serious defect in a one-component jumping developing system. Further, such a phenomenon occurs noticeably in a developing apparatus in which there is no layer thickness regulating means between the plurality of developing sleeves and the plurality of developing sleeves are arranged adjacent to each other.

Further, if the toner scattering occurs at the axial ends of the developing sleeve, photosensitive drum abutting sub-rollers for keeping a distance between the developing sleeve and the photosensitive drum constant will be contaminated by the toner. When the developing apparatus is used for a long term, the toner is accumulated on the abutting sub-rollers, with the result that the distance between the developing sleeve and the photosensitive drum cannot be kept constant (gap is increased), thereby causing reduction in density and/or pitch unevenness. This is particularly unfavorable in a developing system of non-contact developing type in which gap accuracy must be severely controlled, for example, the one-component jumping developing system.

Further, if the toner is scattered at the axial ends of the developing sleeve, the toner will be adhered to the drum or belt (photosensitive member). In this condition, when the image forming apparatus is operated, the toner is fused to ends of the photosensitive member, with the result that poor cleaning may occur in a cleaning portion or contamination at the ends of the photosensitive member mas be accelerated.

In addition, if the toner is scattered at the axial ends of the developing sleeve, the scattered toner will be flying onto a primary charger to contaminate a wire of the primary charger. Particularly, in a low humidity condition, since the charging is unstable, the wire contamination may lead to image unevenness.

SUMMARY OF THE INVENTION

An object of the present invention is to provide a developing apparatus having a plurality of developer bearing members, in which scattering and leakage of developer at ends of the developer bearing members can be suppressed.

Another object of the present invention is to provide a developing apparatus in which an image bearing member and other members disposed around a developer bearing member are prevented from being contaminated by toner.

The other objects and features of the present invention will be apparent from the following detailed explanation referring to the accompanying drawings.

DETAILED DESCRIPTION OF THE PREFERRED EMBODIMENTS

The present invention will now be explained in connection with embodiments thereof with reference to the accompanying drawings.

First of all, an image forming apparatus according to a first embodiment of the present invention will be explained.

Figure 1:
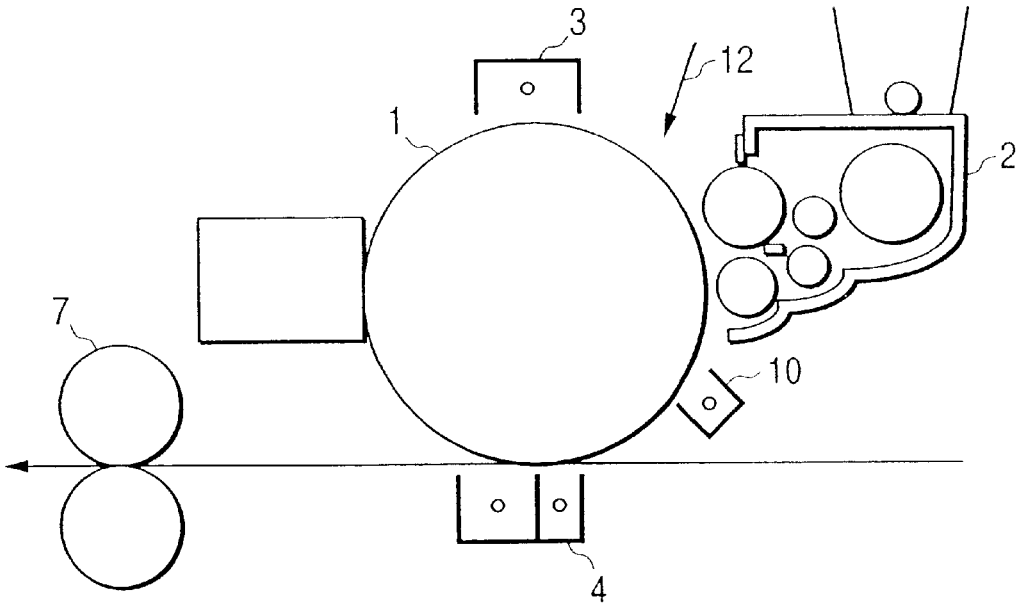
FIG. 1 is a schematic sectional view of an image forming apparatus according to a first embodiment of the present invention.

FIG. 1 shows a schematic construction of the image forming apparatus according to the first embodiment.

The image forming apparatus according to the first embodiment is a monochromatic (white/black) digital copying machine having a process speed of 480 mm/sec capable of producing 90 copies per minute. An a-Si drum photosensitive member having a diameter of 108 mm is used as a photosensitive member (latent image bearing member). The a-Si drum photosensitive member has an endurance life of 3,000,000 copies or more than an organic photosensitive member and is suitable for a high speed machine.

In such an image forming apparatus, as shown in FIG. 1, after a photosensitive member (latent image bearing member) 1 is uniformly charged by a corona charger 3 having a wire, for example, to +500 Volts, image exposure 12 is effected with 600 dpi. The image exposure is a laser beam emitted from a semiconductor laser light source and modulated by an image signal, and the laser beam is deflected by a polygon mirror rotated at a predetermined speed by a motor and then is passed through a focusing lens and is reflected by a reflection mirror. Then, the photosensitive member 1 is raster-scanned by the laser beam, so that a surface potential of the exposed portion is reduced to +100 Volts, for example, thereby forming a latent image. A wavelength is 680 nm.

Thereafter, the latent image is developed by a developing apparatus to form a toner image.

In the illustrated embodiment, development using black magnetic one-component developer which is simple and which has high endurance life of maintenance-free service until a service life of the developing sleeve (2000 k (2,000,000) copies) is effected. The toner is negative toner having a particle diameter of 8.5 um. Further, in the illustrated embodiment, normal development using a plurality of developing sleeves (developer bearing members) is effected.

In the illustrated embodiment, after the electrostatic latent image is developed by the developing device (developing apparatus) 2 as the toner image, the toner image is charged by flowing total electric current of −200 $\mu$A (AC+DC) by means of a post-charger 10. Then, the toner image is transferred, by a transfer charger 4, onto a transfer material advanced toward a direction shown by the arrow. Then, the transfer material is sent to a fixing device (fixing apparatus) 7, where the toner image is fixed to the transfer material.

Next, the developing device 2 used in the illustrated embodiment will be fully explained.

The developer used in the developing device 2 is one-component magnetic toner which is simple and is highly reliable and has high endurance life of maintenance-free service and high productivity.

Figure 2:
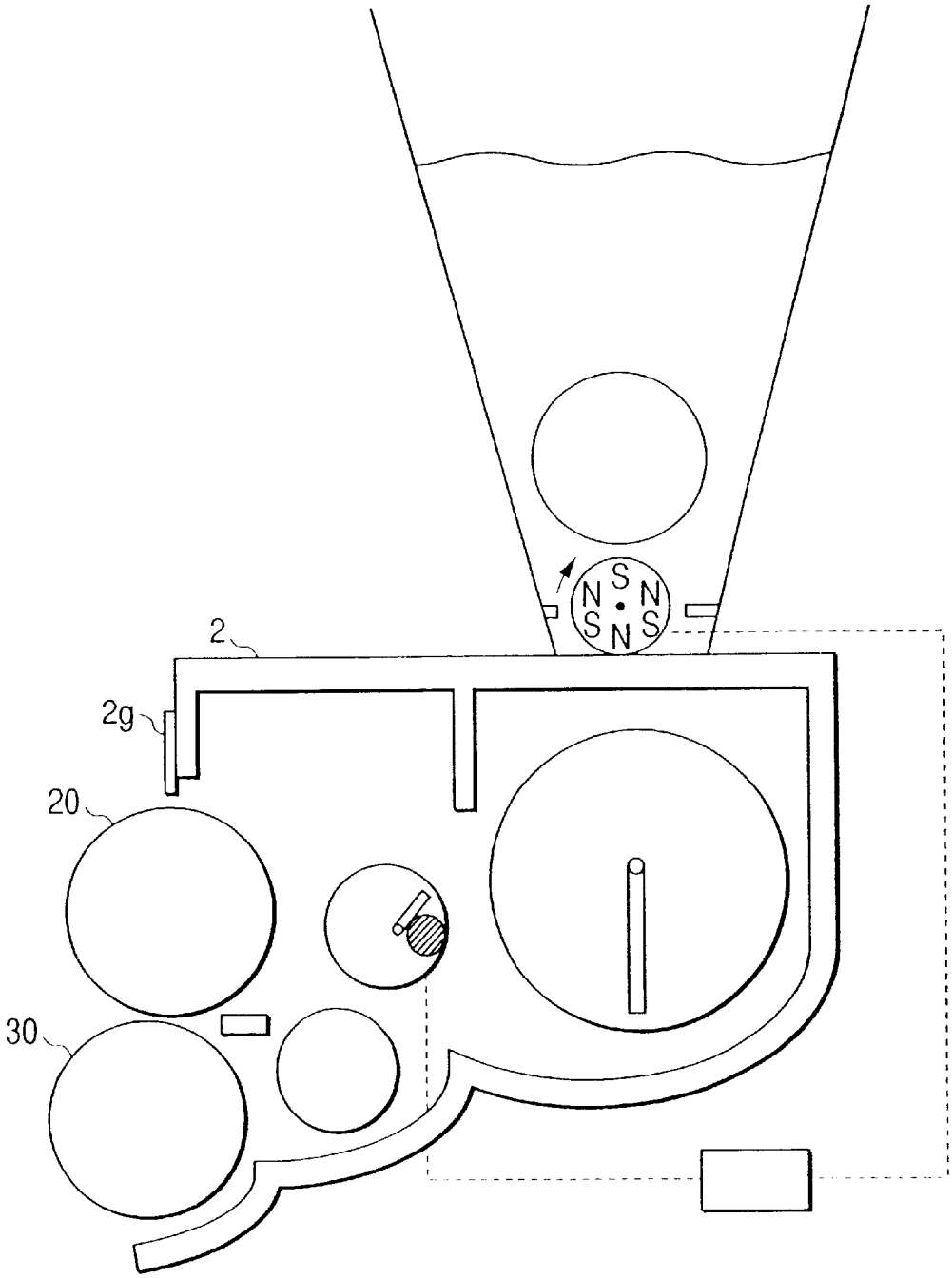
FIG. 2 is a schematic sectional view of a developing apparatus provided in the image forming apparatus of FIG. 1.
Figure 3A:
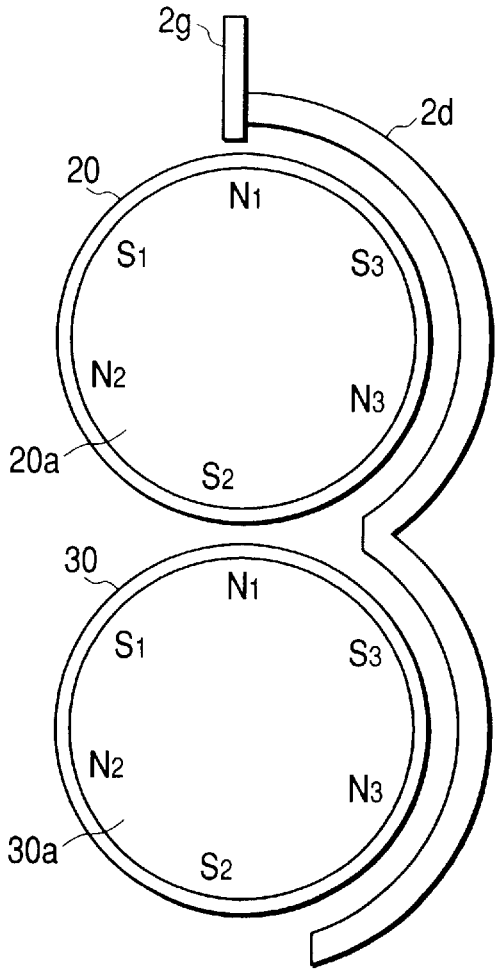
FIG. 3A is a schematic sectional view showing developer bearing members and a developer seal member provided in the developing apparatus of FIG. 2.
Figure 3B:
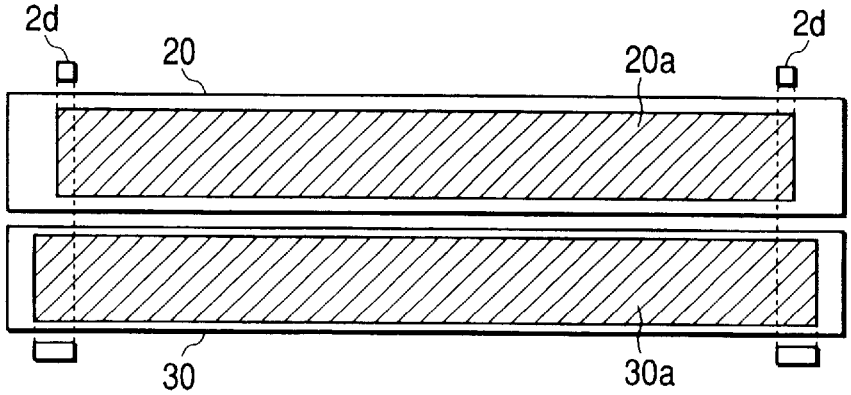
FIG. 3B is a view for explaining the developer bearing members and the developer seal members in a longitudinal direction of the developer bearing members.

As shown in FIGS. 2, 3A and 3B, the developing device 2 has two developing sleeves (developer bearing members) 20, 30. The first developing sleeve (developer bearing member) 20 is constituted by effecting blast treatment with FGB #600 on a cylinder made of aluminum A2017 and having a diameter of 30 mm and by forming, on the cylinder, a film obtained by mixing phenol resin and crystal graphite and carbon with a ratio of 100:36:4. This prevents a ghost image and enhances endurance of the surface of the developing sleeve.

The developing sleeve 20 has a fixed magnet 20*a* fixed within the developing sleeve 20 and has a magnetic field pattern as shown the following Table 1:

TABLE 1

| | magnetic force (G) | angle (°) | half value width (°) |
|---|---|---|---|
| N1 | 950 ($950 \times 10^{-4}$ T) | 0 (0 rad) | 36 ($36 \times \pi/180$ rad) |
| N2 | 900 ($950 \times 10^{-4}$ T) | 60 ($60 \times \pi/180$ rad) | 46 ($46 \times \pi/180$ rad) |
| N3 | 550 ($550 \times 10^{-4}$ T) | 220 ($220 \times \pi/180$ rad) | |
| S1 | 900 ($900 \times 10^{-4}$ T) | 120 ($120 \times \pi/180$ rad) | |
| S2 | 500 ($500 \times 10^{-4}$ T) | 175 ($175 \times \pi/180$ rad) | |
| S3 | 700 ($700 \times 10^{-4}$ T) | 270 ($270 \times \pi/180$ rad) | |

The developing sleeve 20 is rotated at a peripheral speed which is 150% of a peripheral speed of the photosensitive member 1. An amount of toner (toner layer thickness) on the developing sleeve 20 is regulated by a magnetic blade 2*g*. Incidentally, a distance $S-B_{gap}$ between the developing sleeve 20 and the magnetic blade 2*g* is 250 $\mu$m and a distance $S-D_{gap}$ between the first developing sleeve 20 and the photosensitive member 1 is 200 $\mu$m. The toner borne on the developing sleeve 20 is subjected to jumping developing in a condition that it does not contact with the photosensitive member. In order to provide the distance $S-D_{gap}$, the developing sleeve 20 is provided at its both ends with rollers abutting against the photosensitive member 1.

Further, magnetic one-component non-contact developing is effected by a applying DC bias of +200 Volts and a rectangular wave AC bias of $V_{pp}$ 1200 Volts having a frequency of 2.5 kHz to the developing sleeve 20, and accordingly, the developing contrast becomes 300 Volts in a toner flying direction and the fog removing contrast becomes 100 Volts.

The second developing sleeve (developer bearing member) 30 is constituted by forming a film similar to that of the developing sleeve 20 and having a thickness of about 10 $\mu$m on a cylinder (non-magnetic member) made of aluminum A2017 and having a diameter of 30 mm.

The developing sleeve 30 has a magnet 30*a* fixed within the developing sleeve 30 and having a four-pole magnetic field pattern shown in the following Table 2:

TABLE 2

| | magnetic force (G) | angle (°) | half value width (°) |
|---|---|---|---|
| N1 | 900 ($900 \times 10^{-4}$ T) | 330 ($330 \times \pi/180$ rad) | 36 ($36 \times \pi/180$ rad) |
| N2 | 850 ($850 \times 10^{-4}$ T) | 30 ($30 \times \pi/180$ rad) | 46 ($46 \times \pi/180$ rad) |
| N3 | 500 ($500 \times 10^{-4}$ T) | 190 ($190 \times \pi/180$ rad) | |
| S1 | 850 ($850 \times 10^{-4}$ T) | 90 ($90 \times \pi/180$ rad) | |
| S2 | 500 ($500 \times 10^{-4}$ T) | 145 ($145 \times \pi/180$ rad) | |
| S3 | 600 ($600 \times 10^{-4}$ T) | 240 ($240 \times \pi/180$ rad) | |

A DC bias of +200 Volts and a rectangular wave of $V_{pp}$ 1500 Volts having a frequency of 2.7 kHz are applied to the developing sleeve 30.

The developing sleeve 30 is rotated at a peripheral speed which is 100% of a peripheral speed of the photosensitive member 1. An amount of toner (toner layer thickness) on the developing sleeve 30 is regulated by the first developing sleeve 20. A distance (gap) between the developing sleeve 30 and the developing sleeve 20 is 300 μm and a distance $S-D_{gap}$ between the developing sleeve 30 and the photosensitive member 1 is 260 μm. The toner borne on the developing sleeve 30 is subjected to jumping developing in a condition that it does not contact with the photosensitive member. In order to provide the distance $S-D_{gap}$, the developing sleeve 30 is provided at its both ends with rollers abutting against the photosensitive member 1.

Next, developer seal members provided in the developing device 2 will be explained.

As shown in FIGS. 3A and 3B, the developing sleeve 20 includes therein the magnet 20*a* having six magnetic poles N1, N2, N3, S1, S2, S3, and the developing sleeve 30 includes therein the magnet 30*a* having six magnetic poles N1, N2, N3, S1, S2, S3. Magnetic seal members (developer seal members) 2*d* (for two developing sleeves) having a configuration as shown along outer peripheries of the developing sleeves 20, 30 and made of mold alloy (trademark, KN plating; permeability of 10.6) mainly including iron are arranged in the vicinity of both axial ends of the developing sleeves 20, 30, as shown in FIG. 3B. Gaps between the developing sleeves 20, 30 and the magnetic seal members 2*d* are selected to be 420 μm+100 μm along the entire peripheries of the developing sleeves 20, 30.

In the axial direction of the developing sleeves 20, 30, a length L1 of the magnet 20*a* is 304 mm and a length L2 of the magnet 30*a* is 308 mm.

A relationship between the lengths L1, L2 of the developing magnets 20*a*, 30*a* and (I) end toner leakage, (II) wire contamination of a corona charger, (III) roller contamination, (IV) drum end contamination and (V) poor cleaning is shown in the following Table 3:

TABLE 3

Figure 5:
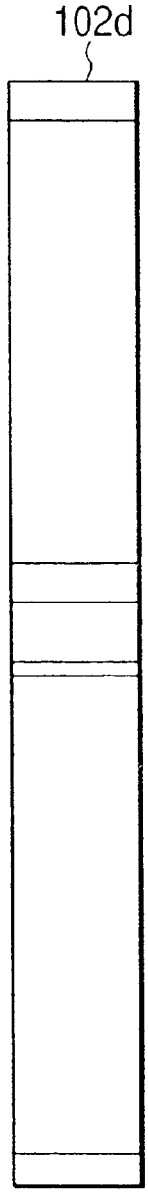
FIG. 5 (PRIOR ART)
FIG. 5 is a view for explaining a configuration of a conventional developer seal member as a comparative example regarding the developer seal members according to the first embodiment of the present invention.

| | I | II | III | IV | V |
|---|---|---|---|---|---|
| L1 ≧ L2 | x | x | x | x | x |
| L1 < L2 | Δ | Δ | Δ | Δ | ○ |

x: fail
Δ: average
○: good
I: end toner leakage
II: wire contamination
III: roller contamination
IV: drum end contamination
V: poor cleaning The magnetic seal in the result of L1≧L2 shown in Table 3 has a configuration as shown in FIG. 5 having a width of 4 mm. The magnetic seals are disposed at both axial ends of the developing sleeve 20 so that outer edges of the magnetic seals are located at positions of 1 mm or less from the both axial ends of the magnet 20*a*.

According to the result shown in Table 3, regarding the proper position of the magnetic seals with respect to the magnet, it is most preferable that the outer edges of the magnetic seals coincide with the end faces of the magnet in the axial direction (longitudinal direction) of the developing sleeve.

The reason is that, if the ends of the magnet protrude from the outer edges of the magnetic seals, a magnetic force will also exist in directions other than the longitudinal direction, with the result that the toner is brought outside by such a magnetic force, thereby causing toner leakage.

Conversely, if the ends of the magnet are retracted inwardly from the outer edges of the magnetic seals too greatly, notwithstanding the magnetic forces do not exist at the outer edges of the magnetic seals for forming the magnetic brushes between the magnetic seals and the magnet to prevent the toner leakage, since the magnetic brushes are formed on the developing sleeve with widths of the magnetic seals, the outer toner leaks at the ends and at the same time the thickness of the toner layer is increased, thereby dripping the toner.

Further, in the longitudinal direction of the developing sleeve and the magnet, since there is looseness between the developing sleeve and the magnet, in consideration of such play, the outer edges of the magnetic seals are located at the positions of 1 mm inwardly from the axial ends of the magnet. As shown in Table 3, comparison is effected regarding the case where the lengths L1, L2 of the magnets are both 304 mm and the cases where the length L1 is 304 mm and L2>L1 or L2<L1.

As a result, it was found that it is preferable that the length of the second developing sleeve (downstream developing sleeve) be longer. The reason is that, when the electrostatic latent image is developed by the first developing sleeve, the scattered toner flows from the longitudinal center toward the ends of the developing sleeve and the toner drops onto the downstream developing sleeve by a gravity force. Particularly, as is in the jumping developing, in a developing system in which AC bias is applied, such a phenomenon becomes noticeable. Further, the reason for flowing the scattered toner from the longitudinal center toward the ends of the developing sleeve is that the scattered toner has an tendency to shift toward less spatial toner density area.

Next, an evaluating reference will be explained.

<End Toner Leakage>
Good (○):
toner amount of 0.5 gram or less during 250 k (250,000) copies;
Average (Δ): from 0.5 to 1.0 gram;
Fail (x): greater than 1.0 gram.
<Wire Contamination (Subjective Evaluation)>
Good (○):
unevenness of halftone portion OK during 250 k copies;
Average (Δ): from 100 k (100,000) to 250 k copies;
Fail (x): smaller than 100 k copies.
<Roller Contamination (Subjective Evaluation)>
Good (○):
unevenness of halftone portion OK during 250 k copies;
Average (Δ): from 100 k to 250 k copies;
Fail (x): smaller than 100 k copies.
<Drum End Contamination>
Good (○):
unevenness of halftone portion OK during 250 k copies;
Average (Δ): from 100 k to 250 k copies;
Fail (x): smaller than 100 k copies.
<Poor Cleaning>
Good (○): 250 k copies OK;
Fail (x): smaller than 250 k copies NG.

Figure 4:
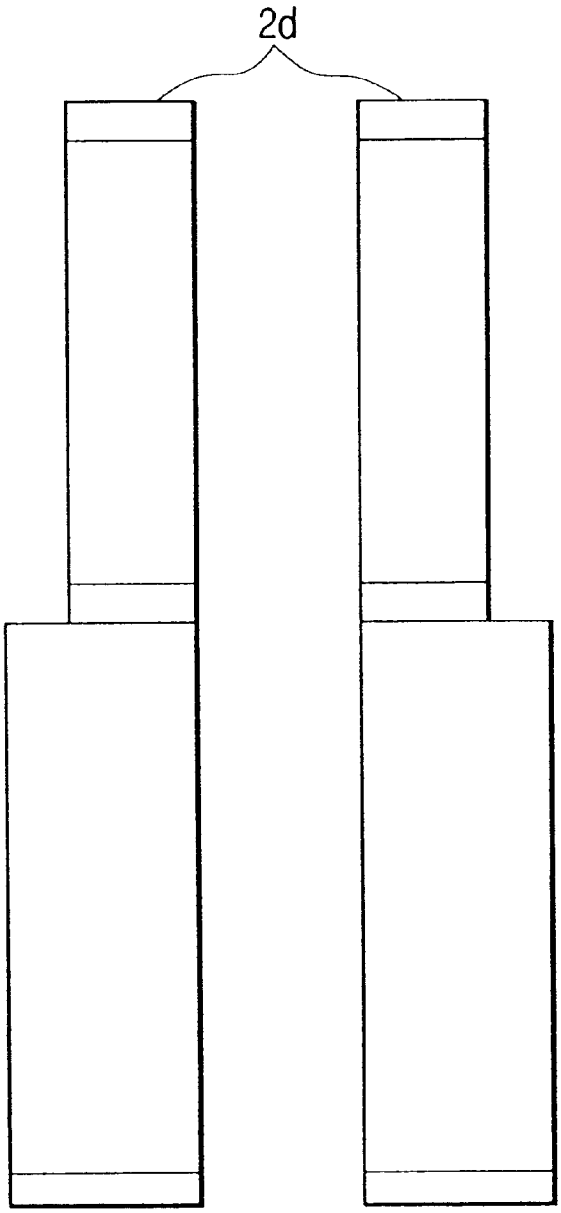
FIG. 4 is a view for explaining a configuration of developer seal members according to a first embodiment of the present invention.

The magnetic seals actually used in the illustrated embodiment are the ones as shown in FIG. 4, and the magnetic seals are located at positions where the outer edges of the magnetic seals are disposed at the positions of 1 mm inwardly from the both axial ends of the magnet. Incidentally, a width of each magnetic seal is 4 mm at an area opposed to the first developing sleeve and 8 mm at an area opposed to the second developing sleeve.

The gaps between the magnetic seals and the developing sleeves are as mentioned above. The gaps are determined in consideration of the width of the magnetic seals suitable for the above-mentioned magnet arrangement and in consideration of the fact that level of toner leakage is optimized by the relationship between the outer edges of the magnetic seals and the axial ends of the magnet as mentioned above. Evaluation in the illustrated embodiment is shown in the following Table 4:

TABLE 4

| | I | II | III | IV | V |
|---|---|---|---|---|---|
| conventional system | x | x | x | x | x |
| improved magnet length | Δ | Δ | Δ | Δ | ○ |
| improved magnet length & improved magnet seal | ○ | ○ | ○ | ○ | ○ |

I: end toner leakage,
II: roller contamination,
III: wire contamination,
IV: drum end contamination,
V: poor cleaning
x: fail, A: average, ○: good Table 4 shows a result of comparison between a conventional case in which the lengths L1, L2 of the magnets are both 304 mm and have uniform widths similar to the magnetic seal 102*d* shown in FIG. 5 and the illustrated embodiment. In the illustrated embodiment, as mentioned above, the length of the magnet 20*a* is 304 mm and the length of the magnet 30 is 308 mm.

As shown in Table 4, from the comparison, it was found that the illustrated embodiment provides good results regarding all of the end toner leakage, the wire contamination, the roller contamination, the drum end contamination, and the poor cleaning. The reason why it is preferable that the width of the downstream area is greater than the width of the upstream area of the magnetic seal is that, when the electrostatic latent image is developed by the developing sleeve 20, the scattered toner flows from the longitudinal center toward the ends of the developing sleeve and the toner drops onto the downstream developing sleeve by a gravity force. Further, by increasing the lengths of the magnetic seals in addition to the fact that it is preferable that the length of the downstream magnet is greater than the length of the upstream magnet, the toner scattered in the first developing portion can easily be caught at the ends of the developing sleeve 30.

With the arrangement as mentioned above, a developing apparatus which is suitable for a high speed image forming apparatus and in which the scattering and leakage of the developer at the ends of the developing sleeves (developer bearing members) are prevented can be provided. Particularly, there can be provided a developing device suitable for a one-component jumping developing system in which an alternating electric field is used at the developing portion and one component developer (which can easily be scattered) not including carrier is used.

Further, there can be provided a developing apparatus in which the photosensitive member abutting roller for keeping the distance between the developing sleeve and the photosensitive member constant are prevented from being contaminated and which can obtain a stripe image having no density reduction and pitch unevenness in the one-component jumping developing system which requires severe gap accuracy and utilizes non-contact developing.

Furthermore, there can be provided a developing apparatus in which the toner can be prevented from being adhered to the drum or belt (photosensitive member) and the poor cleaning at the cleaning portion and the end contamination of the photosensitive member cannot be accelerated.

In addition there can be provided a developing apparatus in which the wire contamination of the primary charger due to the toner scattering from the ends of the developing sleeves can be prevented and can obtain an image having no unevenness.

Further, there can be provided a developing apparatus in which a plurality of developer bearing members are arranged closely adjacent to each other to achieve a high speed operation and to save a space and can maintain high image density and stable operation during the endurance life of 2,000,000 copies.

Next, a second embodiment of the present invention will be explained.

The second embodiment is characterized in that it is applied to a two-color image forming apparatus in which a plurality of latent images are formed on a photosensitive member (latent image bearing member) while the photosensitive member is rotated by one revolution and the latent images are developed by a plurality of developing apparatuses, respectively to form visualized images and then the visualized images are transferred onto a transfer material collectively.

In a multi-color image forming apparatus for effecting normal multi-transferring, the potential of the latent image bearing member is reset by a pre-exposure device whenever the visualized image is transferred. To the contrary, in the illustrated embodiment, after the multi-developing is effected on the latent image bearing member, since the visualized images are transferred onto the transfer material by means of the transfer device collectively, productivity is enhanced.

Further, a main system among developing systems using plural colors is a two-component magnet brush system using non-magnetic one-component developer and carrier; to the contrary, magnetic one-component developing is maintenance-free and has long service life.

Figure 6:
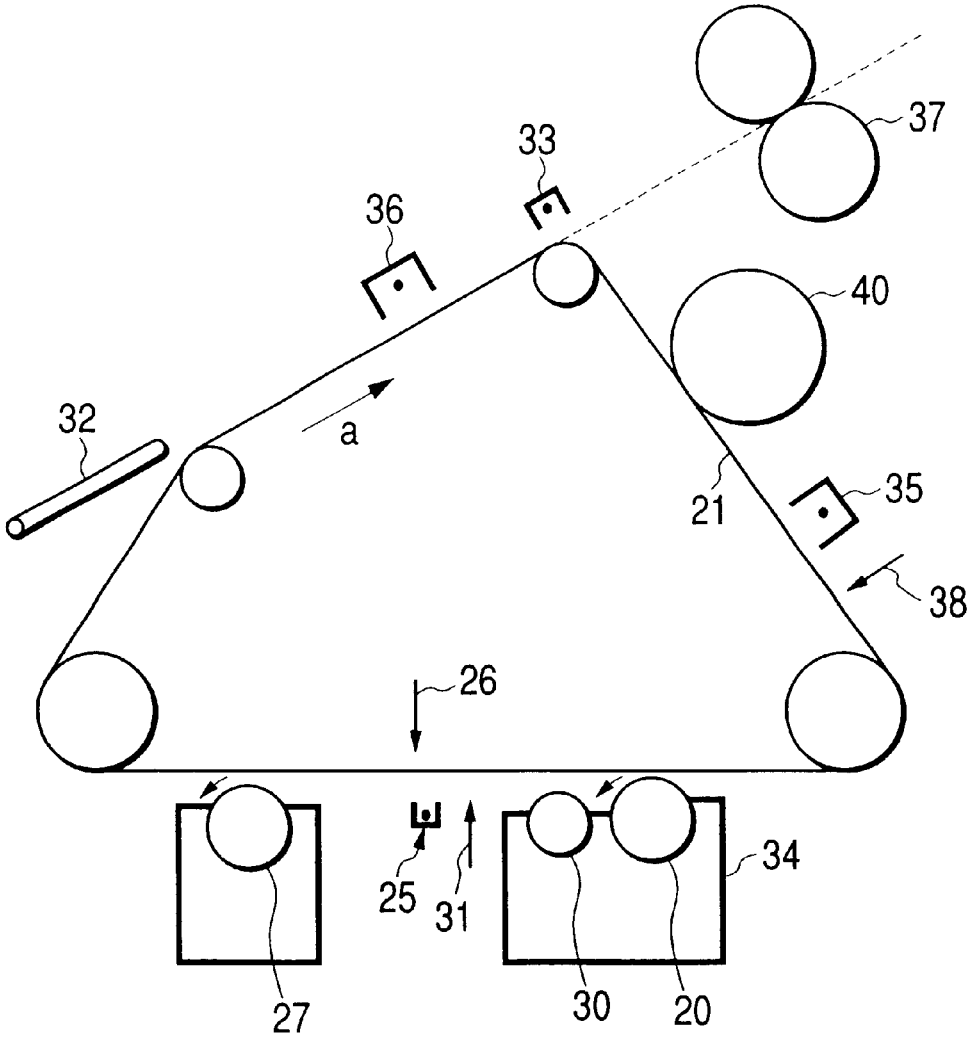
FIG. 6 is a schematic sectional view of an image forming apparatus according to a second embodiment of the present invention.

FIG. 6 is a schematic sectional view of an image forming apparatus according to the second embodiment.

In FIG. 6, an OPC belt photosensitive member 21 is rotated in a direction shown by the arrow a and light is permeable from the back surface of the belt.

After the photosensitive member 21 is uniformly charged by a first corona charger 35, for example, to −600 Volts (dark portion potential), first image exposure 38 is effected. Incidentally, the first image exposure 38 is a first LED of 600 dpi and a wavelength is 670 nm. Further, the image exposure 38 is passed through a focusing lens (not shown) and then is illuminated onto the OPC belt photosensitive member 21, with the result that the surface potential of the exposed portion is reduced in accordance with an image signal level, thereby forming a first latent image (For example, reduced to −100 Volts at a maximum 5 density portion).

The first latent image is developed by a first developing apparatus 34 using developer comprised of negatively charged black one-component toner (having a particle diameter of 6 $\mu$m), and, in the first developing apparatus 34, for example, a DC bias of −500 Volts is applied to a first developing sleeve 20 having a diameter of 32 mm and a bias obtained by overlapping a DC voltage of −200 volts with a triangular wave AC voltage of 2000 Hz and 1500 $V_{pp}$ is applied to a second developing sleeve 30 having a diameter of 20 mm, thereby effecting the reversal developing of the first latent image. In this case, the potential of the toner image is reduced to about −150 Volts (by about 50 Volts) at the maximum density portion due to the chargers of toner.

The first developing sleeve 20 has a distance $S-D_{gap}$ of 120 $\mu$m to the OPC belt photosensitive member 21 and effects contact developing.

The second developing sleeve 30 has a distance 25 $S-D_{gap}$ of 260 $\mu$m to the OPC belt photosensitive member 21 and effects non-contact developing.

Regulation of a thickness of a toner layer on the first developing sleeve 20 is effected by using a blade including a main body having a thickness of 1.0 mm and a tip end portion having a thickness of 0.3 mm and arranged to provide a distance $S-B_{gap}$ of 250 $\mu$m to the developing sleeve. By doing so, a toner coating amount can be reduced stably. The coating amount M/S is selected to 0.8 mg/cm$^2$ regarding the first developing sleeve 20 and 1.05 mg/cm$^2$ regarding the second developing sleeve 30. By doing so, the fog level of the image can be reduced, thereby providing a better image.

After the first latent image is developed by the first developing apparatus 34, the photosensitive member 21 is subjected to entire exposure from the front surface thereof by an EL (electroluminescence) or LED element 31, so that potential of the first toner image at the maximum density portion and dark potential are changed to, for example, −50 Volts and −200 Volts, respectively to reduce the difference in potential.

Then, the photosensitive member is re-charged by a second charger 25, so that the potential of the toner layer at the maximum density portion and dark potential are changed to −670 Volts and −700 Volts, respectively. Namely, the dark potential becomes slightly smaller than the potential of the toner layer at the maximum density portion and the potential of the toner layer at the maximum density portion and the potential of the toner layer at the maximum density portion can achieve second latent image contrast.

Then, exposure is effected by a second LED 26 modulated by a second image signal similar to the first image exposure 38. Similar to the first image exposure, the LED is an LED of 600 dpi and having a wavelength of 670 nm. The image signal from second LED 26 is passed through the focusing lens and then is illuminated onto the photosensitive member 21 from the back surface of the photosensitive member.

A second latent image formed in this way is developed by a second developing apparatus 27 which utilizes red toner and carrier and in which, when operated, the carrier does not contact with the photosensitive member. For example, by applying a bias obtained by overlapping a DC of −570 Volts with an AC of 2000 Hz, 2500 $V_{pp}$ and having a Duty of 35%, only the second latent image is developed while the first toner image is not developed.

Then, toner triboelectricity of the two color images on the photosensitive member 21 is optimized by a charger (not shown) to which a bias obtained by overlapping an AC voltage with a DC voltage, and the two color images are transferred onto a transfer material 32 by a transfer charger 36. Then, the transfer material is separated from the photosensitive member 21 by a separation charger 33 and a curvature of the photosensitive member 21. Then, the transfer material is sent to a fixing device 37, where the images are fixed to the transfer material. Thereafter, the transfer material is discharged out of the image forming apparatus as a two-color print.

On the other hand, after the transferring, residual toner on the photosensitive member 21 is removed by a cleaning device 40, thereby preparing for a next image forming process. Incidentally, the second developing apparatus utilizes a non-contact developing system using two-component developer.

Figure 7:
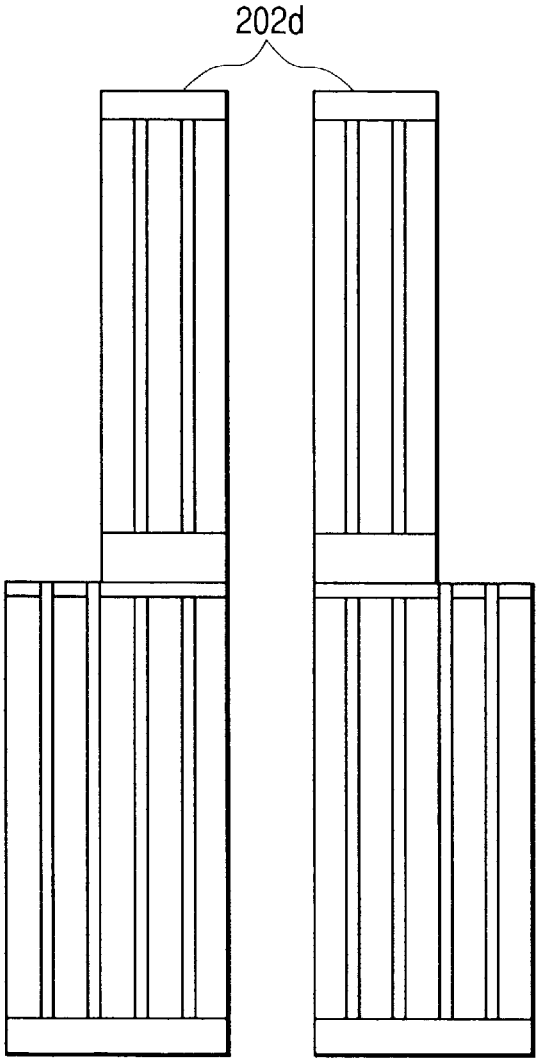
FIG. 7 is a view for explaining configurations of developer seal members according to a second embodiment of the present invention

Developer seal members used in the illustrated embodiment are shown in FIG. 7.

Regarding the magnetic seals (developer seal members) 202*d* according to the illustrated embodiment, lengths of magnets are the same as those in the first embodiment. Further, a width of each magnetic seal 202*d* is 4 mm at an area opposed to the first developing sleeve 20 and 8 mm at an area opposed to the second developing sleeve 30, which is the same as the first embodiment shown in FIG. 4.

As shown in FIG. 7, the illustrated embodiment is characterized in that each magnetic seal 202*d* is provided with grooves in the areas opposed to the developing sleeves 20, 30. A width of each groove is 0.5 mm. A depth of each groove is 1.0 mm.

Evaluation in the second embodiment is shown in the following Table 5:

TABLE 5

| | I | II | III | IV | V | VI |
|---|---|---|---|---|---|---|
| first embodiment | ○ | ○ | ○ | ○ | ○ | Δ |
| second embodiment | ○ | ○ | ○ | ○ | ○ | ○ |

I: end toner leakage,
II: roller contamination,
III: wire contamination,
IV: drum end contamination,
V: poor cleaning,
Vi: gap latitude,
A: average, ○: good The second embodiment in which the magnetic seal members are provided with the grooves was compared with the first embodiment. From Table 5, it was found that the system according to the second embodiment is superior to the first embodiment regarding a gap latitude between the developing sleeve and the magnetic seals. The fact that the gap latitude is wide is very important in the viewpoint of manufacture of the developing apparatus and the cost in the point that accuracy for attaching the magnetic seals is not so severe.

Regarding the evaluating standard for the gap latitude, +50 pm is regarded as average (Δ) and +100, um is regarded as good (○). The latitude is widened by providing the rectangular circumferential grooves, in comparison with a flat magnetic seal and a magnetic seal having sawteeth. The reason is that, by providing the grooves, magnetic restraining forces can be maximized at the grooves.

Accordingly, it is found that the magnetic seal achieves maximum performance when radial rectangular or trapezoidal grooves are provided. When the grooves are provided, since the magnetic toner restraining force is increased due to concentration of a magnetic field, leakage of toner can be suppressed. Further, it is preferable that each groove has a rectangular configuration. Sawtooth configuration of the groove may easily be broken, thereby increasing the cost. Incidentally, the material of the magnetic seal is the same as that in the first embodiment.

With the arrangement as mentioned above, by applying the present invention to a two-color image forming apparatus in which, after the plurality of latent images are formed while the photosensitive member is being rotated by one revolution and the latent images are developed by the plurality of developing apparatuses as the toner images, the toner images are transferred onto the transfer material collectively, a developing apparatus in which the scattering and leakage of the developer at the ends of the developing sleeves (developer bearing members) are prevented can be provided. Particularly, there can be provided a developing device suitable for a high speed one-component jumping developing system in which an alternating electric field is used at the developing portion and one component developer (which can easily be scattered) not including carrier is used.

Further, there can be provided a developing apparatus in which the photosensitive member abutting rollers for keeping the distance between the developing sleeve and the photosensitive member constant are prevented from being contaminated and which can obtain a high quality image having no density reduction and pitch unevenness in the one-component jumping developing system which requires severe gap accuracy and utilizes non-contact developing.

Furthermore, there can be provided a developing apparatus in which the toner can be prevented from being adhered to the drum or belt (photosensitive member) and the poor cleaning at the cleaning portion and the end contamination of the photosensitive member cannot be accelerated.

In addition, there can be provided a developing apparatus in which the wire contamination of the primary charger due to the toner scattering from the ends of the developing sleeves can be prevented and which can obtain an image having no unevenness.

Further, there can be provided a developing apparatus in which a plurality of developer bearing members are arranged closely adjacent to each other to achieve a high speed operation and to save space and can maintain high image density and stable operation during the endurance life of 2,000,000 copies.

Also, there can be provided a magnetic sealing method in which the gap latitude is widened in the viewpoint of manufacture of the developing apparatus and the cost.

Next, a third embodiment of the present invention will be explained.

Figure 8:
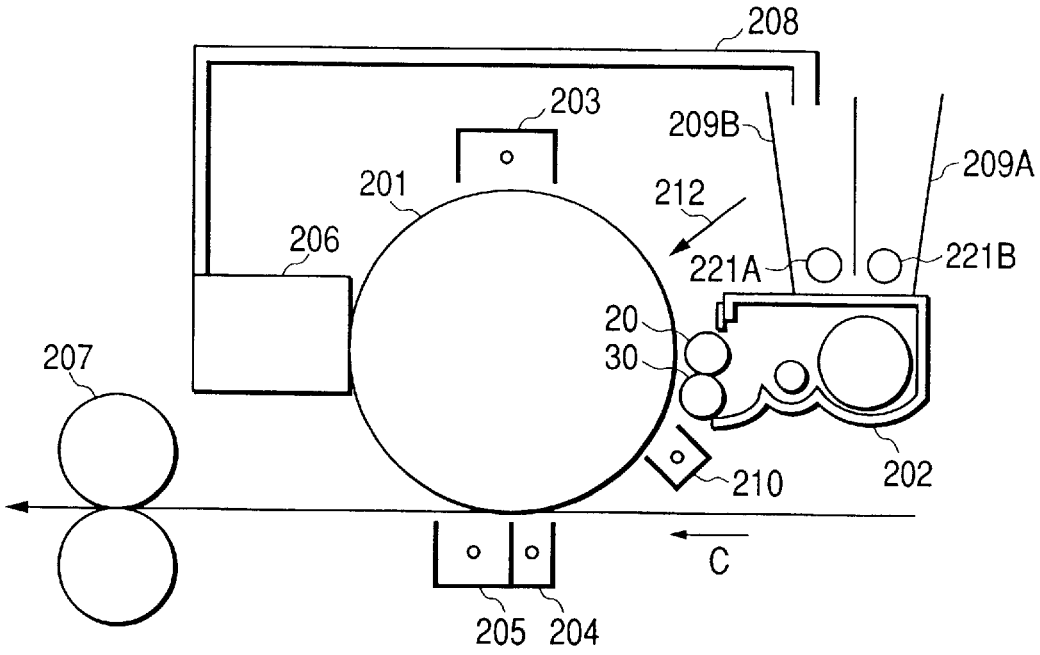
FIG. 8 is a schematic sectional view of an image forming apparatus according to a third embodiment of the present invention.
Figure 10:
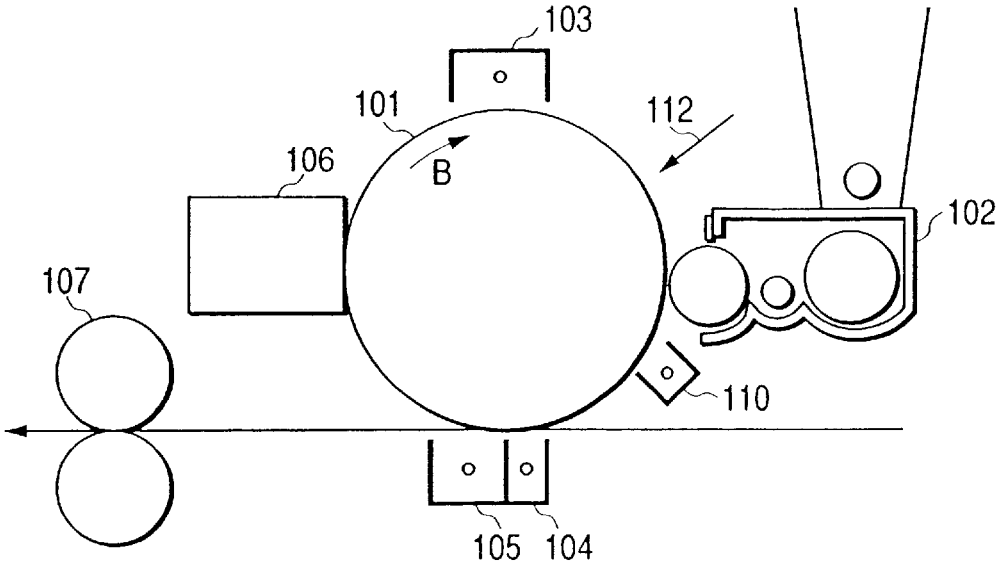
FIG. 10 (PRIOR ART)
FIG. 10 is a schematic sectional view of a conventional image forming apparatus.
Figure 11:
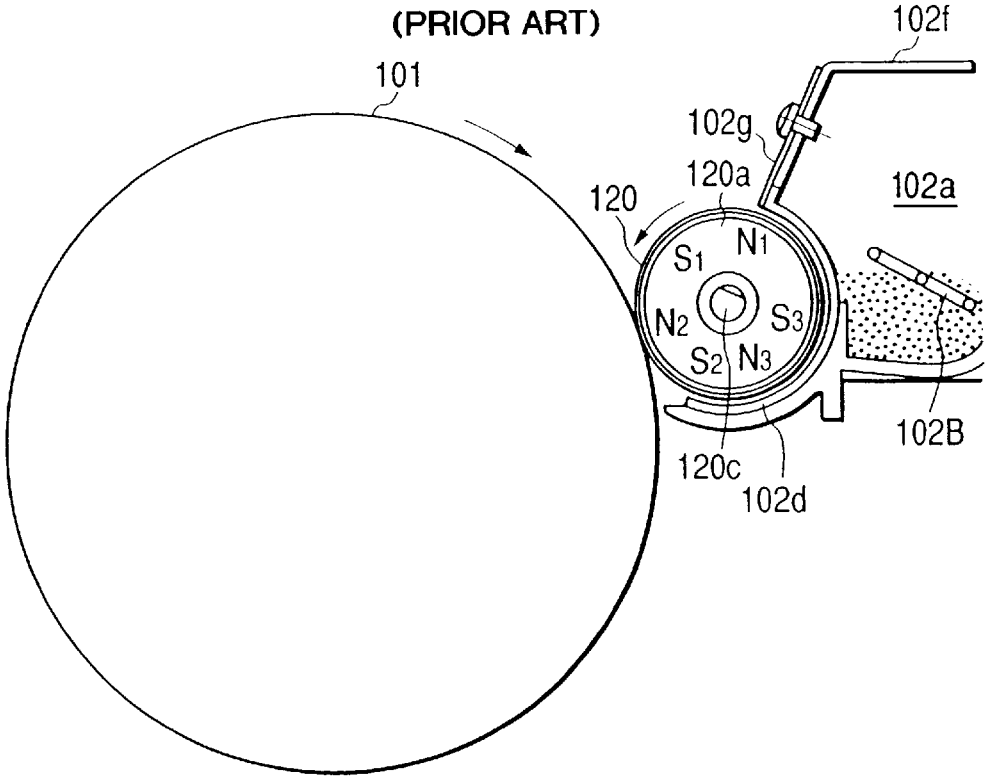
FIG. 11 (PRIOR ART)
FIG. 11 is a schematic sectional view of a conventional developing apparatus.
Figure 12:
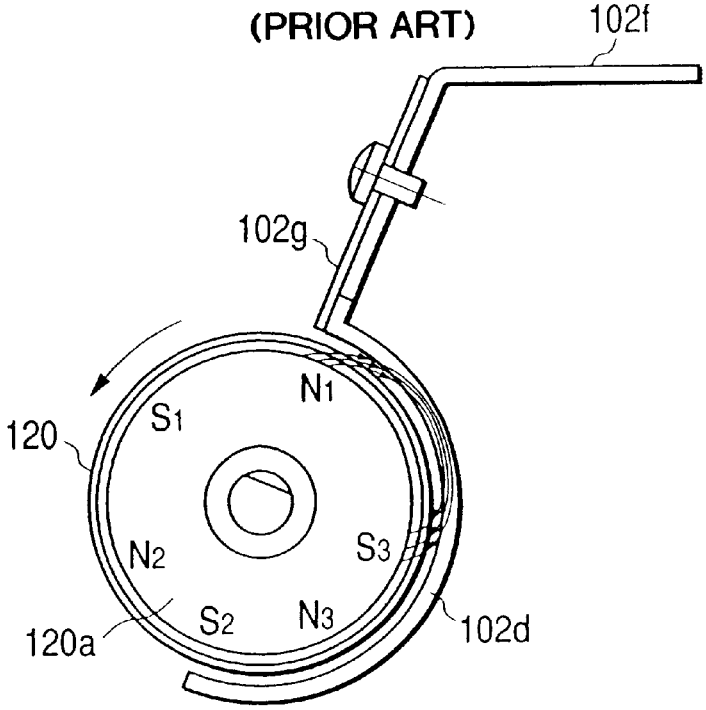
FIG. 12 (PRIOR ART)
FIG. 12 is a view for explaining a relationship between a developer bearing member and a developer seal member provided in the developer apparatus of FIG. 11.
Figure 13:
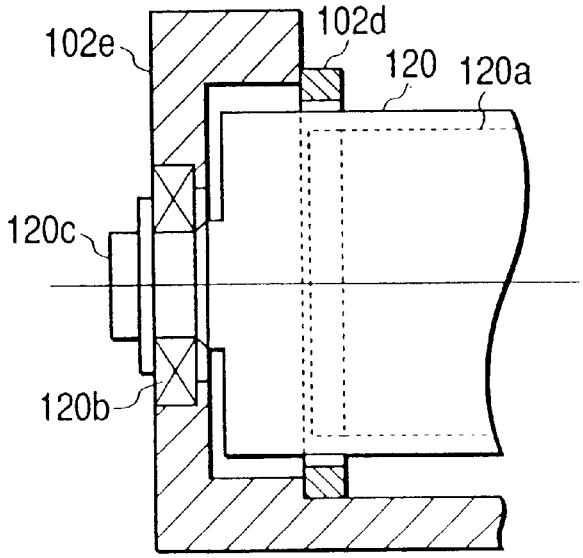
FIG. 13 (PRIOR ART)
FIG. 13 is a view for explaining a relationship between the developer bearing member, a developer container and the developer seal member at an axial end of the developer bearing member provided in the developing apparatus of FIG. 11.

Regarding the third embodiment, an image forming system as shown in FIG. 8, i.e., a digital copying machine as an image forming apparatus in which an a-Si drum is used as a latent image bearing member will be explained. Incidentally, in such a digital copying machine, a process speed is selected to 560 mm/s and 125 copies/minute. The image forming apparatus according to the third embodiment is a reuse type image forming apparatus in which, after the developing process and the transferring process, residual toner remaining on a drum 201 is removed by a cleaning device 206, and the removed toner is returned to a hopper 209B of the developing apparatus through a pipe 208 to be used together with toner in a new toner hopper 209A.

In such a digital copying machine, first of all, a surface of a photosensitive drum (latent image bearing member) 201 is uniformly charged to +500 Volts bv a primary corona charger 203.

Then, the uniformly charged surface of the photosensitive drum 201 is subjected to (PWM) exposure 212 by a semiconductor laser having a wavelength of 680 nm with 600 dpi, thereby forming an electrostatic latent image on the photosensitive drum 201. Then, reversal developing is effected by a developing device (developing apparatus) 202 to visualize the latent image as a toner image.

In the developing device 202, magnetic one-component toner having positive polarity is used as developer, and the jumping developing is effected. The reason is that, when the conventional two-component developer is used, carrier must be exchanged every 100,000 copies by a serviceman (not maintenance-free) thereby not to reflect the merit of reuse so much, but, when the dry magnetic one-component toner is used, maintenance-free operation can be achieved.

Further, in the developing device 202, a developing bias obtained by overlapping a DC voltage of +400 Volts with an AC voltage of 2000 Hz, 1500 $V_{pp}$ and having a Duty of 50% is applied. The distance $S-B_{gap}$ is selected to 250 $\mu$m and the distance $S-D_{gap}$ is selected to 250 $\mu$m.

Thereafter, a total electric current of +200 pA is applied to the photosensitive drum 201 by a post-charger 210 to charge the toner image and then the toner image is transferred, by a transfer charger 204, onto a transfer material shifted in a direction shown by the arrow C. Then, the transfer material is separated from the photosensitive drum 201 by a separation charger 205 and then is sent to a fixing device 207 where the toner image is fixed to the transfer material.

On the other hand, residual toner on the photosensitive drum 201 is removed by a cleaning device 206, and the removed toner (waste toner or reuse toner) is returned to a developing hopper 209B through a conveying pipe 208.

Incidentally, a screw-shaped conveying member is disposed within the conveying pipe to convey the reuse toner by rotation. More specifically, as shown in FIG. 8, the conveyed reuse toner is entered into the developing hopper 209B for reuse. Further, new toner is supplied into a hopper 209A. The respective toners in the hoppers 209B, 209A are attracted by magnetic forces of magnet rollers 221A, 221B, respectively and are conveyed within the developing device 202 by rotations of the magnet rollers 221A, 221B. Incidentally, in the illustrated embodiment, while an example that the reuse toner and new toner is mixed within the developing device was explained, the hopper may have a mixing space where the reuse toner and new toner can be mixed.

The toner mixed in the developing device 202 is sent to the developing sleeves 20, 30 again to be used for developing of the latent image on the photosensitive drum 201. A normal rotational speed of the magnet roller 221A is two revolutions per minute and changes a rotational speed of the magnet roller 221B. A rotational signal of the magnet roller is sent to a piezo-sensor (not shown; manufactured by TDK corporation) in the developing device 202, which piezo-sensor emits a toner supply signal when the weight of toner does not act on the sensor to vibrate it. Normally, the rotational speed of the magnet roller 221B is 10/90 of the rotational speed of the magnet roller 221A (magnet roller 9A: magnet roller 9B=9:1).

Figure 9:
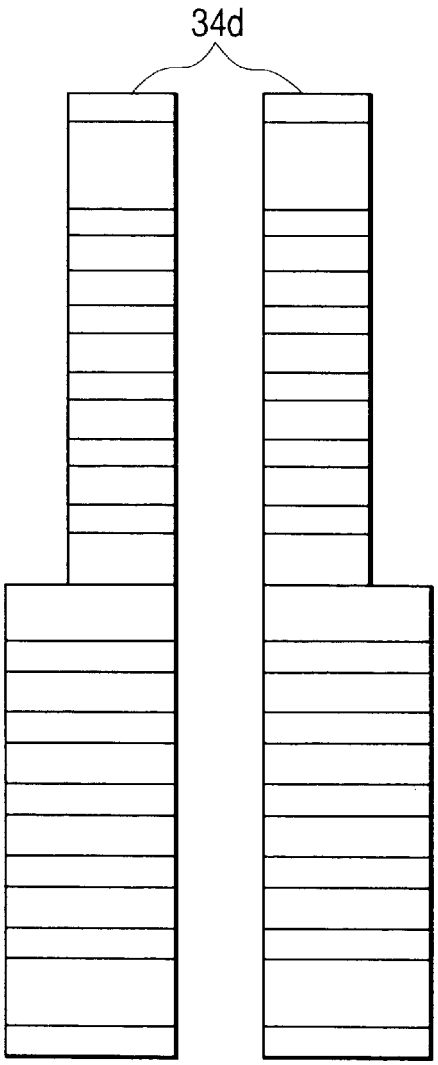
FIG. 9 is a view for explaining configurations of developer seal members according to a third embodiment of the present invention.

Magnetic seals (developer seal members) 34*d* used in the illustrated embodiment are shown in FIG. 9. Incidentally, the lengths of the magnets opposed to the magnetic seals 34*d* are the same as those in the first embodiment.

Similar to the first embodiment, a width of each magnetic seal 34*d* is 4 mm at an area opposed to the first developing sleeve 20 and 8 mm at an area opposed to the second developing sleeve 30.

The illustrated embodiment is characterized in that, as shown, grooves extending in a direction perpendicular to a circumferential direction (i.e., longitudinal direction of the developing sleeves) are formed in the areas of the magnetic seals 34*d* opposed to the developing sleeves 20, 30. A width of each groove is 0.5 mm and a depth of each groove is 1.0 mm.

Evaluation in the illustrated embodiment is shown in the following Table 6:

TABLE 6

| | I | II | III | IV | V | VI |
|---|---|---|---|---|---|---|
| first embodiment | ○ | ○ | ○ | ○ | Δ | Δ |
| third embodiment | ○ | ○ | ○ | ○ | ○ | ○ |

I: end toner leakage,
II: roller contamination,
III: wire contamination,
IV: drum end contamination,
V: poor cleaning,
VI: gap latitude,
Δ: average, ○:good The third embodiment was compared with the first embodiment. In the third embodiment, since the waste toner from the cleaning device is re-used and thus aggregated toner is much in comparison with a system using new toner only, greater load is generated in the cleaning. Accordingly, this system is severe or critical to the poor cleaning. If the scattering and leakage of toner occur at the end of the developing sleeves, not only the drum end contamination but also cleaning end turn-over will easily occur.

From the above Table 6, it is found that this system is effective also in the reused system using the waste toner.

Further, regarding the gap latitude between the developing sleeves and the magnetic seals, it is found that it is excellent due to presence of the grooves. Similar to the second embodiment, the fact that the gap latitude is wide is very important in the viewpoint of manufacture of the developing apparatus and the cost in the point that accuracy for attaching the magnetic seals is not so severe. The latitude is also widened by providing circumferential rectangular grooves. The reason is that, by providing the grooves, magnetic restraining forces can be maximized at the grooves. Accordingly, it is found that the magnetic seal achieves maximum performance also when the circumferential rectangular or trapezoidal grooves are provided, When the grooves are provided, since the magnetic toner restraining force is increased due to concentration of a magnetic field, leakage of toner can be suppressed. Further, it is preferable that each groove has a rectangular configuration. Sawtooth configuration of the groove may easily be broken, thereby increasing the cost. Incidentally, the material of the magnetic seal is the same as that in the second embodiment.

With the arrangement as mentioned above, the third embodiment can provide a reuse image forming apparatus which can maintain image quality up to endurance life of 3,000,000 copies and which is maintenance-free and has good running cost and which is compatible with environmental conditions, and can provide a developing apparatus for a super high speed copying machine, in which the scattering and leakage of toner at the ends of the developing sleeves (developer bearing members) can be prevented, and, particularly, there can be provided a developing device suitable for a one-component jumping developing system in which an alternating electric field is used at the developing portion and one component developer (which can easily be scattered) not including carrier is used.

Further, there can be provided a developing apparatus in which the photosensitive member abutting rollers for keeping the distance between the developing sleeve and the photosensitive member constant are prevented from being contaminated and which can obtain a high quality image having no density reduction and pitch unevenness in the one-component jumping developing system which requires severe gap accuracy and utilizes non-contact developing.

Furthermore, there can be provided a developing apparatus in which the toner can be prevented from being adhered to the drum or belt (photosensitive member) and the poor cleaning at the cleaning portion and the end contamination of the photosensitive member cannot be accelerated.

In addition, there can be provided a developing apparatus in which the wire contamination of the primary charger due to the toner scattering from the ends of the developing sleeves can be prevented and which can obtain an image having no unevenness.

Further, there can be provided a developing apparatus in which a plurality of developer bearing members are arranged closely adjacent to each other to achieve a high speed operation and to save space and can maintain high image density and stable operation during the endurance life of 3,000,000 copies.

What is claimed is:

1. A developing apparatus comprising:

a first developer bearing member and a second developer bearing member disposed at a downstream side of said first developer bearing member with respect to an image bearing member, said first and second developer bearing members bearing developer to develop an electrostatic image formed on said image bearing member with the developer;

a first magnetic seal portion opposed to a peripheral surface of said first developer bearing member at longitudinal ends thereof and adapted to magnetically seal the developer; and a second magnetic seal portion opposed to a peripheral surface of said second developer bearing member at longitudinal ends thereof and adapted to magnetically seal the developer;

wherein, in a longitudinal direction of said first developer bearing member, a width of said second magnetic seal portion opposed to said second developer bearing member is greater than a width of said first magnetic seal portion opposed to said first developer bearing member.

2. A developing apparatus according to claim 1, wherein said first developer bearing member includes first magnetic field generating means having a plurality of magnetic poles therein and said second developer bearing member includes second magnetic field generating means having a plurality of magnetic poles therein, and, in the longitudinal direction of said first developer bearing member, a length of said second magnetic field generating means is greater than a length of said first magnetic field generating means.

3. A developing apparatus according to claim 1, wherein a plurality of grooves are formed in a surface of said first magnetic seal portion opposed to said first developer bearing member and a surface of said second magnetic seal portion opposed to said second developer bearing member.

4. A developing apparatus according to claim 1, wherein the developer is a one-component magnetic developer.

5. A developing apparatus according to claim 1, wherein said first and second developer bearing members are disposed adjacent to each other.

6. A developing apparatus according to claim 1, further comprising a single developer container within which said first developer bearing member and said second developer bearing member are disposed.

7. A developing apparatus according to claim 1, wherein said first developer bearing member and said second developer bearing member are opposed to said image bearing member with a gap formed therebetween.

8. A developing apparatus according to claim 1, wherein said second developer bearing member is disposed below said first developer bearing member.

9. A developing apparatus comprising:

a first developer bearing member and second developer bearing member for bearing a developer to develop a common electrostatic latent image formed on an image bearing member with the developer, said second developer bearing member being disposed lower than said first developer bearing member in a direction such that a gravitational force exerted on said second developer bearing member is stronger than the gravitational force exerted on said first developer bearing member;

a first magnetic seal portion opposed to a peripheral surface of said first developer bearing member at longitudinal ends thereof and adapted to magnetically seal the developer; and a second magnetic seal portion opposed to a peripheral surface of said second developer bearing member at longitudinal ends thereof and adapted to magnetically seal the developer;

wherein, at one end side in a longitudinal direction of said first and second developer bearing members, said second magnetic seal portion includes an area overlapping said first magnetic seal portion and an area extending outwardly from an outer end portion of said first magnetic seal portion.

10. A developing apparatus according to claim 9, wherein, in the longitudinal direction of said first and second developer bearing members, a width of said second magnetic seal portion is greater than a width of said first magnetic seal portion.

11. A developing apparatus according to claims 9 or 10, wherein said first developer bearing member includes first magnetic field generating means having a plurality of magnetic poles therein and said second developer bearing member includes second magnetic field generating means having a plurality of magnetic poles therein, and, in the longitudinal direction of said first developer bearing member, a length of said first magnetic field generating means is greater than a length of said second magnetic field generating means.

12. A developing apparatus according to claim 9, wherein a plurality of grooves are formed in a surface of said first magnetic seal portion opposed to said first developer bearing member and a surface of said second magnetic seal portion opposed to said second developer bearing member.

13. A developing apparatus according to claim 9, wherein the developer is a one-component magnetic developer.

14. A new developing apparatus according to claim 9, further comprising a single developer container within which said first developer bearing member and said second developer bearing member are disposed.

15. A developing apparatus according to claim 9, wherein said first and second developer bearing members are disposed adjacent to each other.

16. A developing apparatus according to claim 9, wherein said first and second developer bearing members are opposed to said image bearing member with a gap therebetween.

17. A developing apparatus according to any one of claims 9, 15, or 16, wherein, in developing, an alternating electric field is formed in an area where said first developer bearing member is opposed to said image bearing member.

18. A developing apparatus according to claim 9, wherein said second developer bearing member is disposed at a downstream side of said first developer bearing member in a moving direction of said image bearing member.

19. A developing apparatus comprising:

a first developer bearing member and second developer bearing member for bearing a developer to develop a common electrostatic latent image formed on an image bearing member with the developer, said second developer bearing member being provided at a downstream side of a moving direction of said image bearing member;

a first magnetic seal portion opposed to a peripheral surface of said first developer bearing member at longitudinal ends thereof and adapted to magnetically seal the developer; and a second magnetic seal portion opposed to a peripheral surface of said second developer bearing member at longitudinal ends thereof and adapted to magnetically seal the developer;

wherein, at one end side in a longitudinal direction of said first developer bearing member and said second developer bearing member, said second magnetic seal portion includes an area overlapping said first magnetic seal portion and an area extending outwardly from an outer end portion of said first magnetic seal portion, in a direction rectangular to the longitudinal direction.

20. A developing apparatus according to claim 19, wherein, in the longitudinal direction of said first developer bearing member and said second developer bearing member, a width of said second magnetic seal portion is greater than a width of said first magnetic seal portion.

21. A developing apparatus according to claims 19 or 20, wherein said first developer bearing member includes first magnetic field generating means having a plurality of magnetic poles therein and said second developer bearing member includes second magnetic field generating means having a plurality of magnetic poles therein, and, in the longitudinal direction of said first and second developer bearing members, a length of said first magnetic field generating means is greater than a length of said second magnetic field generating means.

22. A developing apparatus according to claim 19, wherein a plurality of grooves are formed in a surface of said first magnetic seal portion opposed to said first developer bearing member and a surface of said second magnetic seal portion opposed to said second developer bearing member.

23. A developing apparatus according to claim 19, wherein the developer is a one-component magnetic developer.

24. A developing apparatus according to claim 19, further comprising a single developer container within which said first developer bearing member and said second developer bearing member are disposed.

25. A developing apparatus according to claim 19, wherein said first developer bearing member and said second developer bearing member are disposed adjacent to each other.

26. A developing apparatus according to claim 19, wherein said first and second developer bearing members are opposed to said image bearing member with a gap formed therebetween.

27. A developing apparatus according to any one of claims 19, 25, or 26, wherein, in developing, an alternating electric field is formed in an area where said first developer member is opposed to said image bearing member.

28. A developing apparatus according to claim 19, wherein said second developer bearing member is disposed lower than said first developer bearing member in a gravity direction.

* * * * *